US009759435B2

(12) United States Patent
Jewell et al.

(10) Patent No.: US 9,759,435 B2
(45) Date of Patent: Sep. 12, 2017

(54) PACKAGED TERMINAL AIR CONDITIONER UNIT

(71) Applicant: General Electric Company, Schenectady, NY (US)

(72) Inventors: Robert William Jewell, Louisville, KY (US); Jeffrey Alan Angle, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 330 days.

(21) Appl. No.: 14/633,186

(22) Filed: Feb. 27, 2015

(65) Prior Publication Data

US 2016/0252260 A1 Sep. 1, 2016

(51) Int. Cl.

| | |
|---|---|
| ***F24F 1/22*** | (2011.01) |
| ***F24F 1/02*** | (2011.01) |
| ***F24F 13/20*** | (2006.01) |

(52) U.S. Cl.

CPC ..... *F24F 1/022* (2013.01); *F24F 13/20* (2013.01); *F24F 2013/207* (2013.01)

(58) Field of Classification Search

CPC ..... F24F 2013/207; F24F 13/20

See application file for complete search history.

(56) References Cited

U.S. PATENT DOCUMENTS

| | | | | |
|---|---|---|---|---|
| 6,009,717 | A * | 1/2000 | Hernandez | F24F 1/027 62/262 |
| 8,047,013 | B2 | 11/2011 | Ishikawa et al. | |
| 2010/0193233 | A1* | 8/2010 | Miura | H05K 1/116 174/261 |
| 2011/0216511 | A1* | 9/2011 | Gunderson | H05K 7/00 361/752 |
| 2015/0009626 | A1* | 1/2015 | Lan | H05K 7/20163 361/696 |

FOREIGN PATENT DOCUMENTS

| | | |
|---|---|---|
| KR | 100819682 B1 | 4/2008 |

* cited by examiner

*Primary Examiner* — Cassey D Bauer
(74) *Attorney, Agent, or Firm* — Dority & Manning, P.A.

(57) ABSTRACT

A packaged terminal air conditioner unit includes a compressor, an interior coil and an exterior coil positioned within a casing. A control board enclosure is also positioned within the casing. A cover of the control board housing is rotatable on a substantially-horizontal axis relative to a housing of the control board housing. A control board is mounted to the cover of the control board enclosure such that the control board is rotatable on the substantially-horizontal axis with the cover of the control board enclosure.

12 Claims, 6 Drawing Sheets

PACKAGED TERMINAL AIR CONDITIONER UNIT

FIELD OF THE INVENTION

The present subject matter relates generally to packaged terminal air conditioner units and control boards for the same.

BACKGROUND OF THE INVENTION

Packaged terminal air conditioner units generally include a casing and a sealed system. The sealed system includes components for chilling and/or heating air with refrigerant. A control board of the packaged terminal air conditioner units may operate the sealed system in either a heating mode or a cooling mode depending upon the setting selected by a user of the packaged terminal air conditioner units.

Due to space constraints within the casing, selection of components for packaged terminal air conditioner units can be limited. For example, the control board is generally connected to various components of the packaged terminal air conditioner unit with suitable wiring or cables. Properly securing the electrical cables to the control board can be difficult within the confined space of the casing. In particular, accessing the electrical cables and/or the control board during servicing of the packaged terminal air conditioner unit can be difficult within the confined space of the casing.

Accordingly, a packaged terminal air conditioner unit with features for facilitating access to a control board of the packaged terminal air conditioner unit would be useful. In addition, a packaged terminal air conditioner unit with features for assisting with attaching wiring or cables to a control board of the packaged terminal air conditioner unit would be useful.

BRIEF DESCRIPTION OF THE INVENTION

The present subject matter provides a packaged terminal air conditioner unit. The packaged terminal air conditioner unit includes a compressor, an interior coil and an exterior coil positioned within a casing. A control board enclosure is also positioned within the casing. A cover of the control board housing is rotatable on a substantially-horizontal axis relative to a housing of the control board housing. A control board is mounted to the cover of the control board enclosure such that the control board is rotatable on the substantially-horizontal axis with the cover of the control board enclosure. Additional aspects and advantages of the invention will be set forth in part in the following description, or may be apparent from the description, or may be learned through practice of the invention.

In a first exemplary embodiment, a packaged terminal air conditioner unit is provided. The packaged terminal air conditioner unit includes a casing. A compressor is positioned within the casing. The compressor is operable to increase a pressure of a refrigerant. An interior coil is positioned within the casing, and an exterior coil is positioned within the casing opposite the interior coil. A control board enclosure is also positioned within the casing. The control board enclosure has a housing and a cover. The cover is mounted to the housing. The cover is rotatable on a substantially-horizontal axis relative to the housing. A control board is mounted to the cover of the control board enclosure such that the control board is rotatable on the substantially-horizontal axis with the cover of the control board enclosure.

In a second exemplary embodiment, a packaged terminal air conditioner unit is provided. The packaged terminal air conditioner unit includes a casing that extends between an exterior side portion and an interior side portion. A compressor is positioned within the casing. The compressor is operable to compress a refrigerant. An interior coil is positioned within the casing at the interior side portion of the casing, and an exterior coil is positioned within the casing at the exterior side portion of the casing. The packaged terminal air conditioner unit also includes an inner wall with a control board enclosure. The inner wall is positioned within the casing between the interior coil and the exterior coil. The control board enclosure has a housing and a cover. The housing defines an interior volume, and the cover is mounted to the housing in order to provide selective access to the interior volume of the housing. The cover extends between a top edge and a bottom edge. The cover is rotatable on a substantially-horizontal axis relative to the housing at the bottom edge of the cover. A control board is mounted to the cover of the control board enclosure and positioned within the interior volume of the housing. The control board is rotatable on the substantially-horizontal axis with the cover of the control board enclosure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
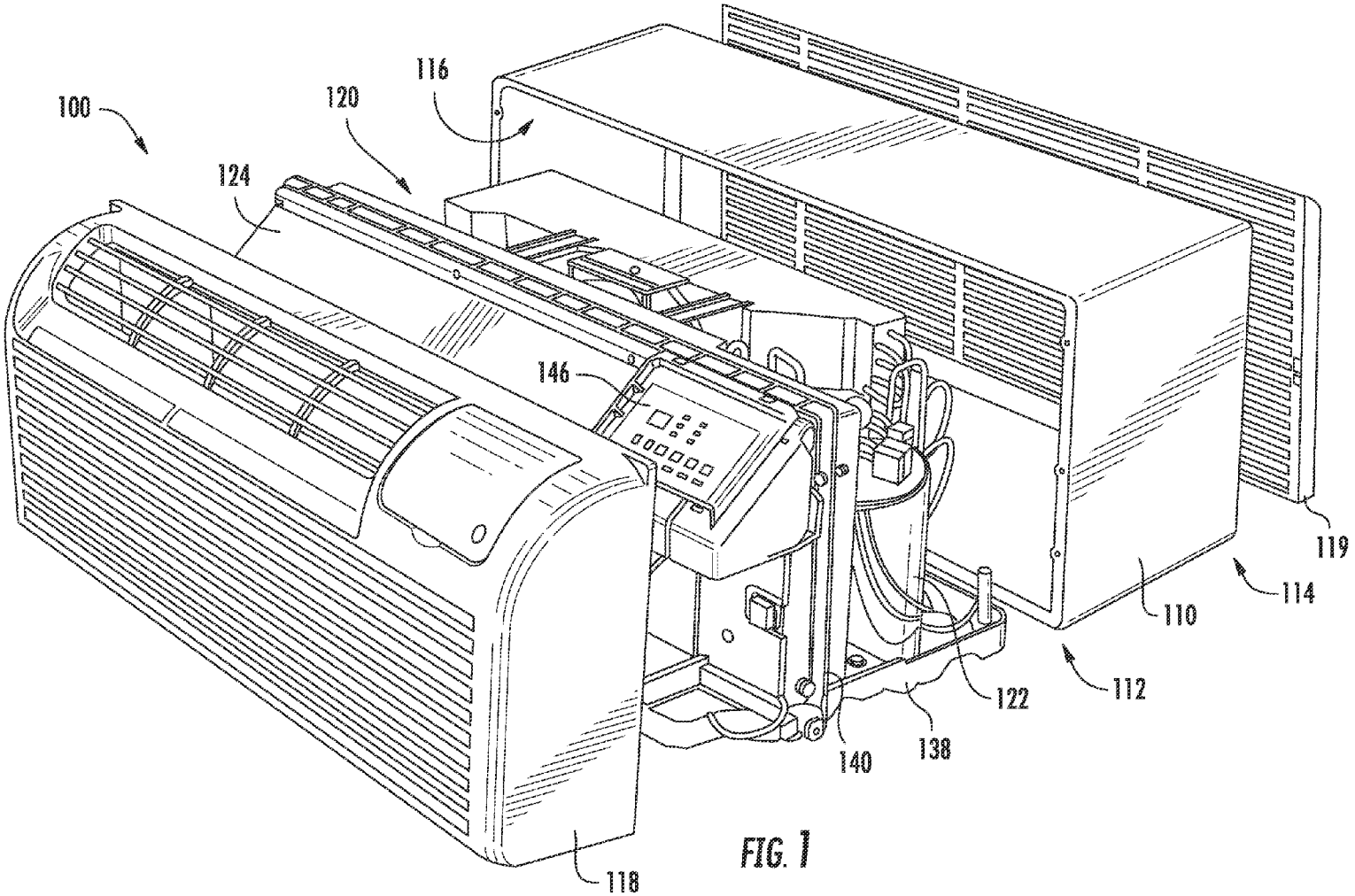
FIG. 1 provides an exploded perspective view of a packaged terminal air conditioner unit according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an exemplary embodiment of the present subject matter. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 are mounted to casing 110 and hinder or limit access to mechanical compartment 116 of casing 110. Front panel 118 is mounted to casing 110 at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall 140 positioned within mechanical compartment 116 of casing 110. Sealed system 120 is positioned on bottom tray 138. Thus, liquid runoff from sealed system 120 may flow into and collect within bottom tray 138. Inner wall 140 may be mounted to bottom tray 138 and extend upwardly from bottom tray 138 to a top wall of casing 110. Inner wall 140 limits or prevents air flow between interior side portion 112 of casing 110 and exterior side portion 114 of casing 110 within mechanical compartment 116 of casing 110. Thus, inner wall 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
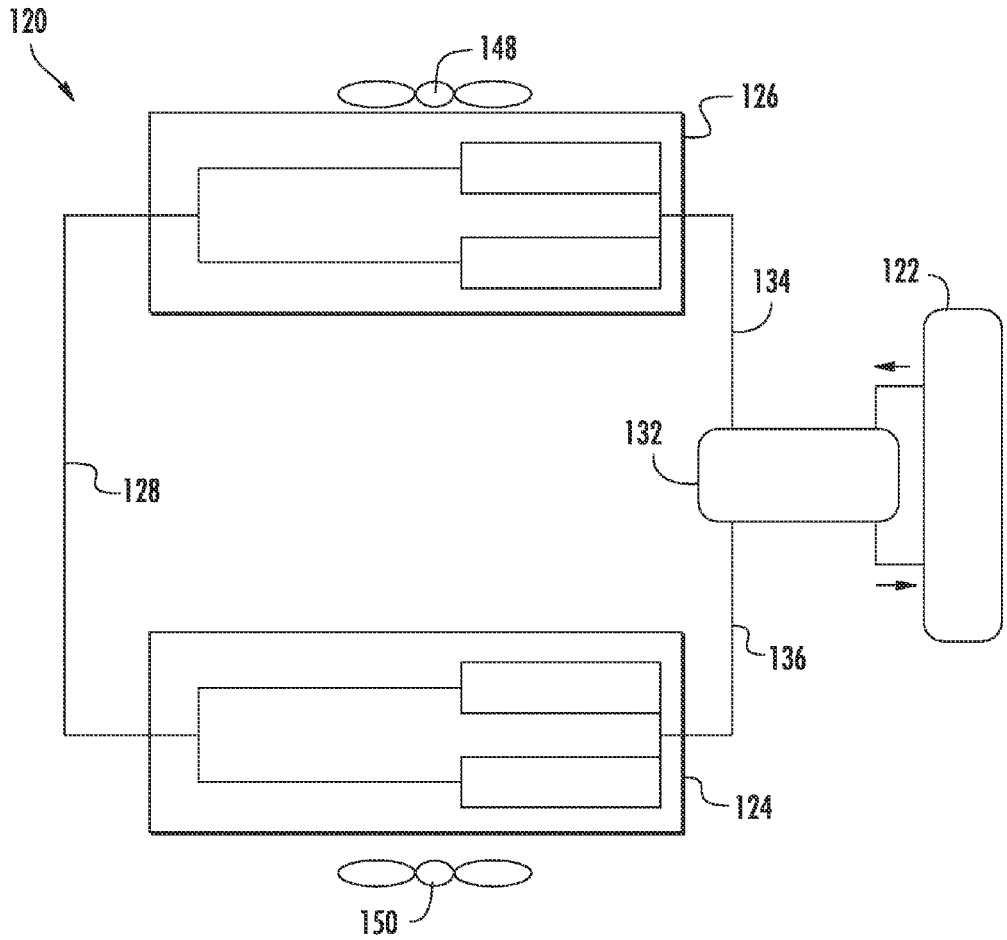
FIG. 2 provides a schematic view of certain components of the exemplary packaged terminal air conditioner unit of FIG. 1.

FIG. 2 provides a schematic view of certain components of packaged terminal air conditioner unit 100, including sealed system 120. Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 2, sealed system 120 also includes a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 150 is positioned adjacent exterior coil 126 may facilitate or urge a flow of air from the exterior atmosphere across exterior coil 126 in order to facilitate heat transfer.

Sealed system 120 also includes a capillary tube 128 disposed between interior coil 124 and exterior coil 126, e.g., such that capillary tube 128 extends between and fluidly couples interior coil 124 and exterior coil 126. Refrigerant, which may be in the form of high liquid quality/saturated liquid vapor mixture, may exit exterior coil 126 and travel through capillary tube 128 before flowing through interior coil 124. Capillary tube 128 may generally expand the refrigerant, lowering the pressure and temperature thereof. The refrigerant may then be flowed through interior coil 124.

Interior coil 124 is disposed downstream of capillary tube 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from capillary tube 128 may enter interior coil 124 via a second distribution conduit 136 that extends between and fluidly connects interior coil 124 and reversing valve 132. Within interior coil 124, the refrigerant from capillary tube 128 receives energy from the interior atmosphere and vaporizes into superheated vapor and/or high quality vapor mixture. An interior air handler or fan 148 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of capillary tube 128 in the heating mode and acts as an evaporator, e.g., such that exterior coil 126 is operable to heat refrigerant within exterior coil 126 with energy from the exterior atmosphere at exterior side portion 114 of casing 110.

It should be understood that sealed system 120 described above is provided by way of example only. In alternative exemplary embodiments, sealed system 120 may include any suitable components for heating and/or cooling air with a refrigerant. Similarly, sealed system 120 may have any suitable arrangement or configuration of components for heating and/or cooling air with a refrigerant in alternative exemplary embodiments.

Figure 3:
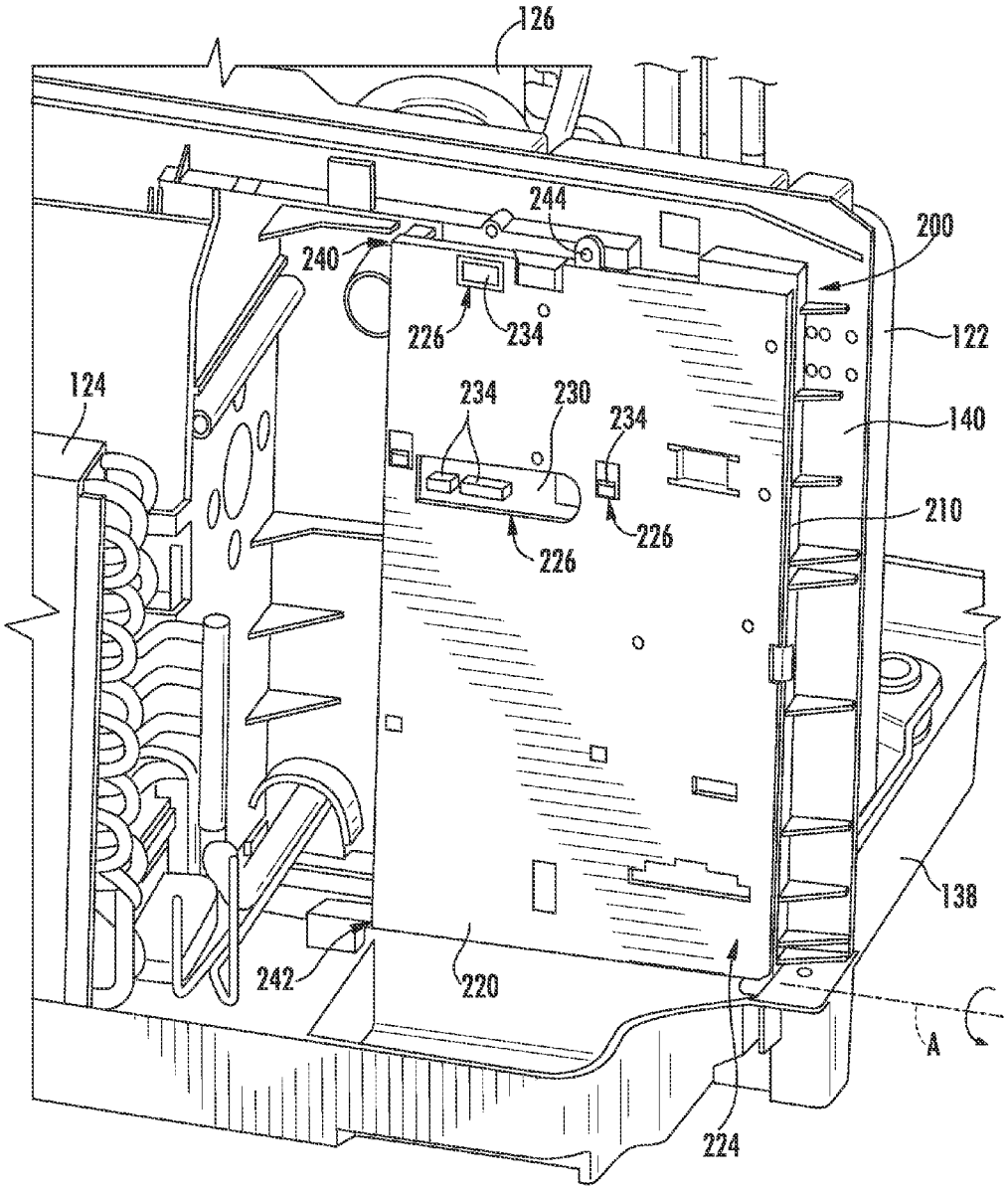
FIG. 3 provides a partial, perspective view of a control board enclosure of the exemplary packaged terminal air conditioner unit of FIG. 1.
Figure 4:
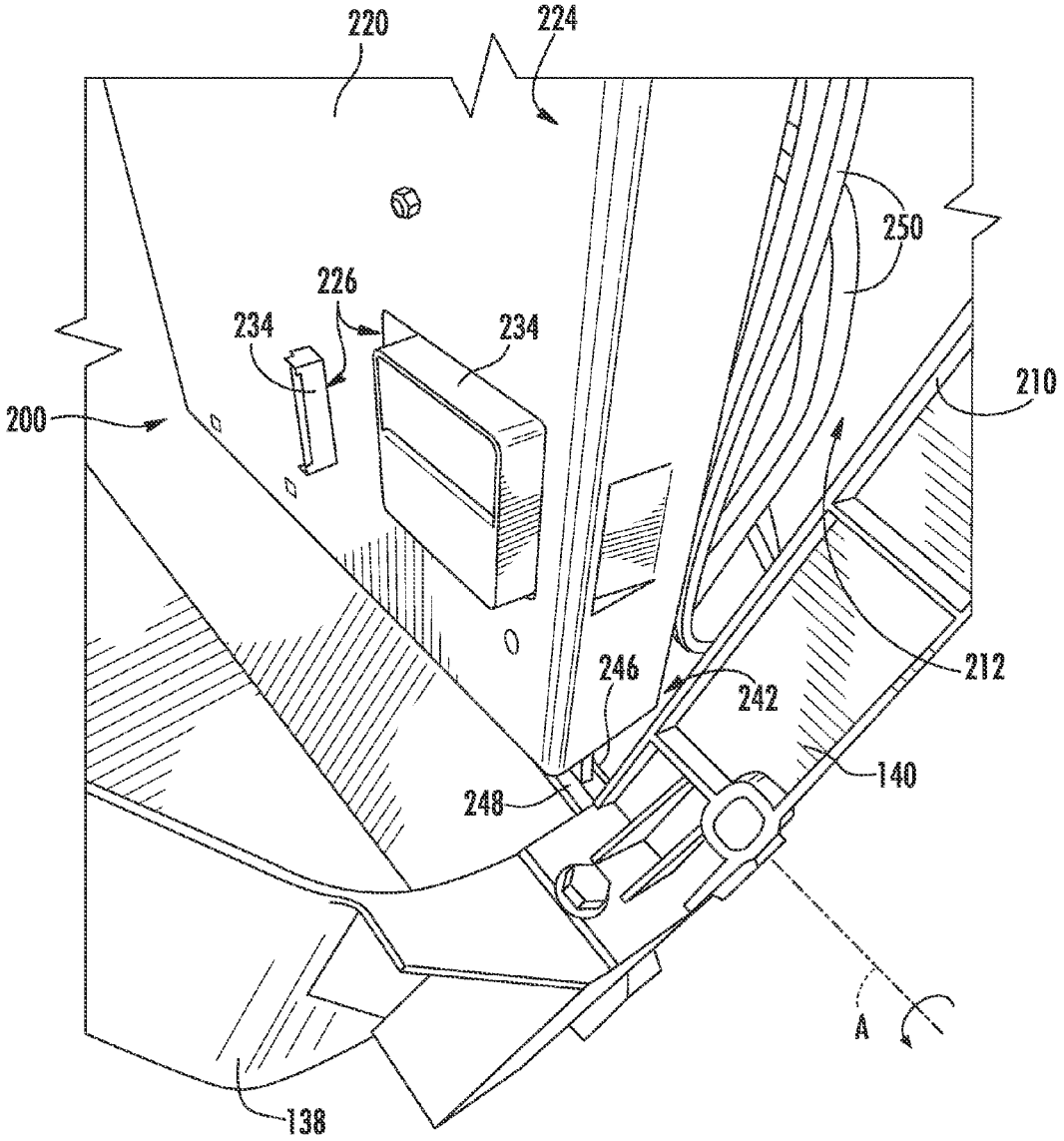
FIG. 4 provides a partial, perspective view of a bottom portion of the control board enclosure of the exemplary packaged terminal air conditioner unit of FIG. 1.

FIG. 3 provides a partial, perspective view of a control board enclosure 200 of packaged terminal air conditioner unit 100. FIG. 4 provides a partial, perspective view of a bottom portion of control board enclosure 200. Control board enclosure 200 may be positioned or disposed within casing 110 (FIG. 1). As may be seen in FIGS. 3 and 4, control board enclosure 200 includes a housing 210 and a cover 220. Housing 210 may be mounted or fixed to inner wall 140 and/or bottom tray 138, e.g., such that housing 210 is static relative to inner wall 140 and/or bottom tray 138. In certain exemplary embodiments, housing 210 may be defined by inner wall 140. In particular, inner wall 140 may be formed of molded plastic, and housing 210 may be formed from the molded plastic of inner wall 140 in certain exemplary embodiments.

Cover 220 may be selectively mounted to housing 210. Thus, e.g., a technician may remove cover 220 from housing 210 during servicing of packaged terminal air conditioner unit 100. As may be seen in FIG. 4, housing 210 defines an interior volume 212. Cover 220 is selectively mounted to housing 210 in order to provide selective access to interior volume 212 of housing 210. Thus, cover 220 hinders or prevents access to interior volume 212 of housing 210 when cover 220 is mounted to housing 210, and cover 220 may be removed or rotated relative to housing 210 in order to access interior volume 212 of housing 210. In FIG. 2, cover 220 is shown mounted to housing 210 such that cover 220 hinders or prevents access to interior volume 212 of housing 210. Housing 210 and cover 220 of control board enclosure 200 may be constructed of any suitable, e.g., heat-resistant, material. For example, housing 210 and/or cover 220 of control board enclosure 200 may be constructed of a metal, such as steel, in certain exemplary embodiments.

As discussed above, cover 220 may be removed from housing 210 or rotated relative to housing 210 (e.g., from the position shown in FIG. 2) in order to access interior volume 212 of housing 210. In particular, cover 220 is rotatable on a substantially-horizontal (e.g., within ten degrees of horizontal) axis A relative to housing 210 during removal of cover 220 from housing 210. For example, cover 220 extends between a top portion 240 and a bottom portion 242. Cover 220 may be mounted to bottom tray 138 at bottom portion 242 of cover 220 such that cover 220 is rotatable on the substantially-horizontal axis A relative to housing 210 at bottom edge 242 of cover 240.

Cover 220 may be rotatable by any suitable amount on the substantially-horizontal axis A relative to housing 210. For example, cover 220 may be rotatable by more than forty-five degrees and less than one hundred and thirty-five degrees on the substantially-horizontal axis A relative to housing 210. As another example, cover 220 may be rotatable by about (e.g., within ten degrees of) ninety degrees on the substantially-horizontal axis A relative to housing 210.

As may be seen in FIG. 4, a lip 246 may extend downwardly from cover 220 at bottom portion 242 cover 220. Lip 246 is received within a slot defined by a ledge 248 of bottom tray 138. Lip 246 may assist with mounting cover 220 to housing 210, e.g., by preventing movement of bottom portion 242 of cover 220. In particular, lip 246 and ledge 248 may act as hinge to permit rotation of cover 220 relative to housing 210 while hindering linear translation of bottom portion 242 of cover 220 relative to housing 210 in certain directions. For example, lip 246 may impact against ledge 248 to hinder movement of bottom portion 242 of cover 220 away from housing 210. However, lip 246 may also permit rotation of cover 220 relative to housing 210, e.g., by rotating or pivoting within the slot defined by ledge 248 during removal of cover 220 from housing 210. A fastener 244 may secure of fix cover 220 to housing 210 at top portion 240 of cover 220. It should be understood that cover 220 may be mounted to housing 210 such that cover 220 is rotatable relative to housing 210 using any other suitable method or mechanism in alternative exemplary embodiments. For example, cover 220 may be mounted to housing 210 with any other suitable hinge.

Figure 5:
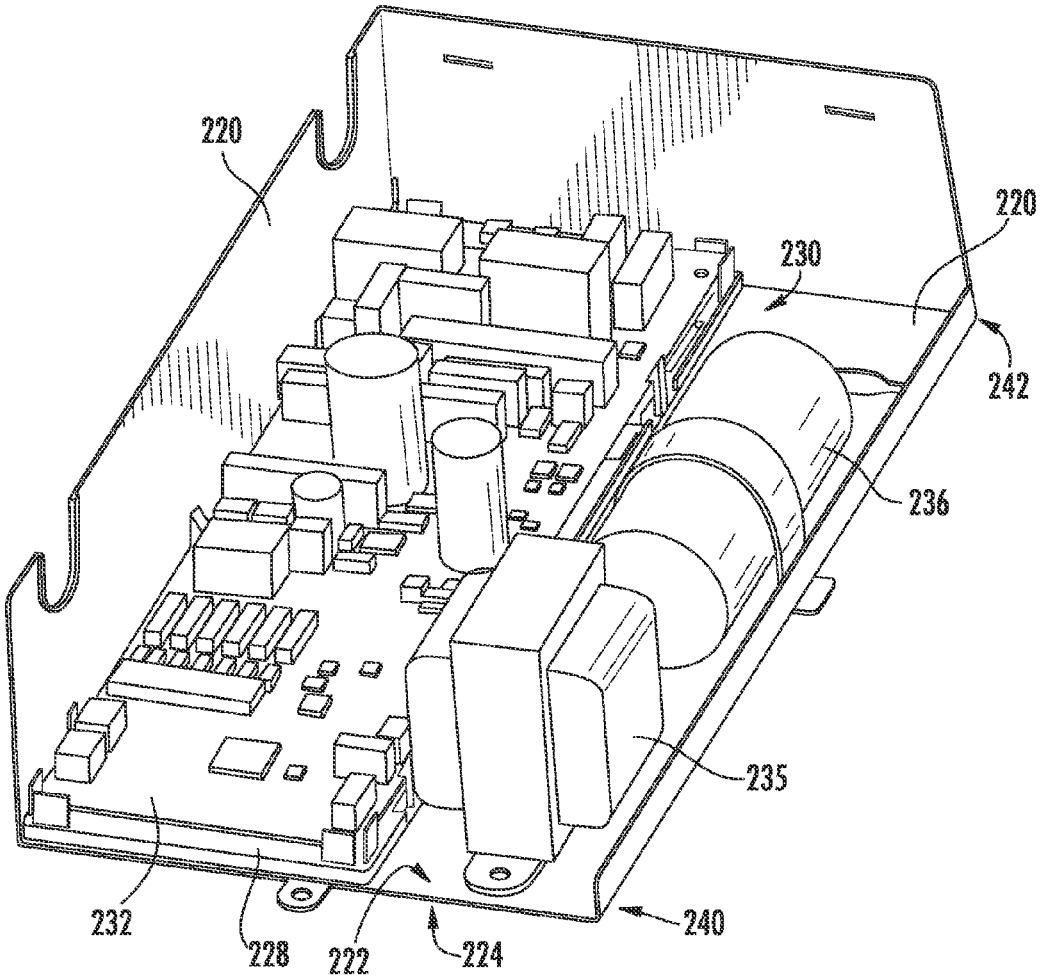
FIG. 5 provides a rear, perspective view of a cover of the control board enclosure of the exemplary packaged terminal air conditioner unit of FIG. 1.

FIG. 5 provides a rear, perspective view of cover 220 of control board enclosure 200. As may be seen in FIG. 5, a control board 230 is fixed or mounted to cover 220, e.g., such that control board 230 is rotatable on the substantially-horizontal axis A with cover 220. In particular, cover 220 has an inner surface 222 and an outer surface 224. Inner and outer surfaces 222, 224 of cover 220 are positioned opposite each other on cover 220, and inner surface 222 of cover 220 faces interior volume 212 of housing 210 when cover 220 is mounted to housing 210. Control board 230 is positioned at or on inner surface 222 of cover 220. A transformer 236 and a capacitor 238 are also mounted to cover 220, e.g., at or on inner surface 222 of cover 220, such that transformer 236 and capacitor 238 are rotatable on the substantially-horizontal axis A with cover 220. Thus, various control components of packaged terminal air conditioner unit 100 may be mounted or fixed to cover 220. Turning back to FIG. 4, control board, 230, transformer 236, capacitor 238 and wiring 250 from such components may be positioned within interior volume 212 of housing 210 when cover 220 is mounted to housing 210.

By rotating on the substantially-horizontal axis A relative to housing 210 with cover 220, access to control board 230 may be facilitated. For example, when cover 220 is rotated on the substantially-horizontal axis A relative to housing 210, e.g., from the vertical position of cover 220 shown in FIG. 3 until cover 220 is substantially horizontal as shown in FIG. 5, a service technician may easily access control board 230 in order to remove and/or replace components of control board 230 or install a replacement control board. Thus, rotation of cover 220 on the substantially-horizontal axis A relative to housing 210 may facilitate access to control board 230 and/or other components of packaged terminal air conditioner unit 100 mounted to cover 220 or positioned within interior volume 212 of housing 210.

As may be seen in FIGS. 3 and 5, control board 230 includes a printed circuit board 232 and a plurality of electrical connectors 234. Printed circuit board 232 is positioned at or on inner surface 222 of cover 220. Electrical connectors 234 extend from printed circuit board 232 through cover 220 towards outer surface 224 of cover 220. Electrical connectors 234 include plugs, sockets, etc. that permit electrical inputs to be delivered to printed circuit board 232 and electrical output to be delivered from printed circuit board 232. For example, electrical connectors 234 may include a temperature sensor input, a user interface input, a power supply input, a test port, etc. Electrical connectors 234 are positioned such that electrical connectors 234 are accessible at or from outer surface 224 of cover 220, e.g., when cover 220 is mounted to housing 210. For example, cover 220 may define a plurality of holes 226 that extend between inner and outer surfaces 222, 224 of cover 220. Each electrical connector of electrical connectors 234 is positioned at and/or extends through, e.g., a respective, one of holes 226 of cover 220 in order to permit access to electrical connectors 234 through cover 220 via holes 226. Thus, e.g., after mounting cover 220 to housing 210, an assembly worker can access electrical connectors 234 at outer surface 224 of cover 220 and connect associated wiring to electrical connectors 234 without removing cover 220 from housing 210. As another example, a service technician can disconnect and reconnect associated wiring to electrical connectors 234 without removing cover 220 from housing 210 during servicing of packaged terminal air conditioner unit 100.

Figure 6:
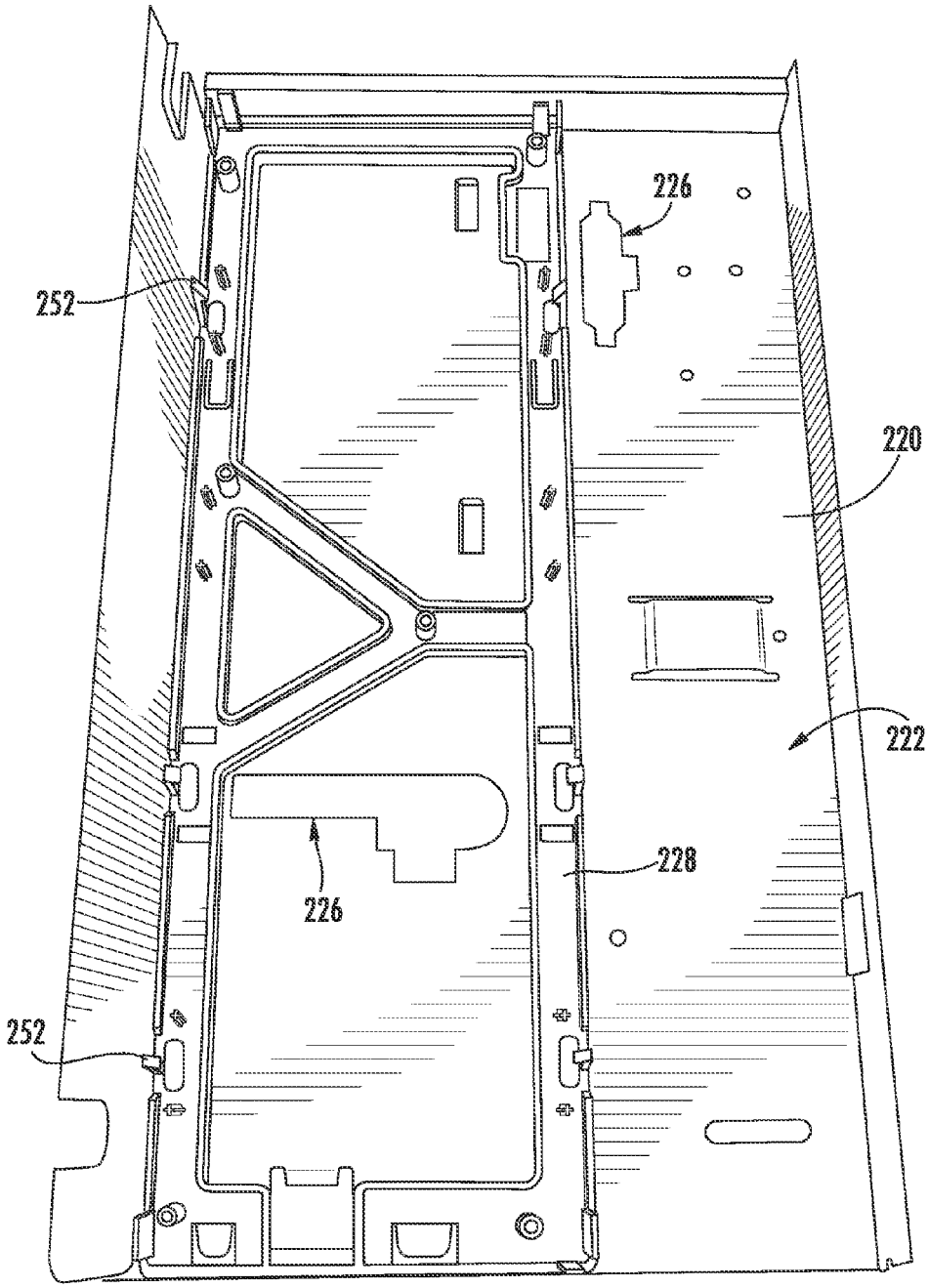
FIG. 6 provides another rear, perspective view of the cover of the control board enclosure of the exemplary packaged terminal air conditioner unit of FIG. 1.

FIG. 6 provides another rear, perspective view of cover 220. As may be seen in FIG. 6, a frame 228 may be mounted to cover 220 at inner surface 222 of cover 220. Frame 228 may generally correspond to the shape of printed circuit board 232 and includes hooks or snaps 252 along edges of frame 228 that receive printed circuit board 232 in order to snap-fit printed circuit board 232 to frame 228 and cover 220. It should be understood that control board 230 may be mounted to cover 220 using any other suitable method or mechanism in alternative exemplary embodiments. For example, fasteners, adhesive, etc. may be used to mount control board 230 to cover 220 in alternative exemplary embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit, comprising:

a casing;

a compressor positioned within the casing, the compressor operable to increase a pressure of a refrigerant;

an interior coil positioned within the casing;

an exterior coil positioned within the casing opposite the interior coil;

a control board enclosure positioned within the casing, the control board enclosure having a housing and a cover, the cover mounted to the housing, the cover rotatable on a substantially-horizontal axis relative to the housing; and a control board mounted to the cover of the control board enclosure such that the control board is rotatable on the substantially-horizontal axis with the cover of the control board enclosure, wherein the housing of the control board enclosure defines an interior volume, the cover of the control board enclosure having an inner surface and an outer surface positioned opposite each other on the cover of the control board enclosure, the inner surface of the cover facing the interior volume of the housing, the control board positioned at the inner surface of the cover, wherein the control board comprises a printed circuit board and a plurality of electrical connectors, the printed circuit board positioned at the inner surface of the cover, the plurality of electrical connectors extending from the printed circuit board through the cover of the control board towards the outer surface of the cover, and wherein plurality of electrical connectors are positioned such that the plurality of electrical connectors are accessible at the outer surface of the cover when the cover of the control board enclosure is mounted to the housing of the control board enclosure.

2. The packaged terminal air conditioner unit of claim 1, wherein the housing of the control board enclosure defines an interior volume, the cover of the control board enclosure selectively mounted to the housing of the control board enclosure in order to provide selective access to the interior volume of the housing.

3. The packaged terminal air conditioner unit of claim 1, wherein the control board is snap-fit to the cover of the control board enclosure on the inner surface of the cover.

4. The packaged terminal air conditioner unit of claim 1, further comprising a transformer and a capacitor mounted to the cover of the control board enclosure such that the transformer and the capacitor are rotatable on the substantially-horizontal axis with the cover of the control board enclosure.

5. The packaged terminal air conditioner unit of claim 1, wherein the cover of the control board enclosure extends between a top edge and a bottom edge, the cover of the control board enclosure rotatable on the substantially-horizontal axis relative to the housing at the bottom edge of the cover.

6. The packaged terminal air conditioner unit of claim 1, further comprising an inner wall positioned within the casing between the interior coil and the exterior coil, the control board enclosure mounted to the inner wall.

7. The packaged terminal air conditioner unit of claim 1, wherein the housing and cover of the control board enclosure are constructed of a metal.

8. A packaged terminal air conditioner unit, comprising:

a casing extending between an exterior side portion and an interior side portion;

a compressor positioned within the casing, the compressor operable to compress a refrigerant;

an interior coil positioned within the casing at the interior side portion of the casing;

an exterior coil positioned within the casing at the exterior side portion of the casing;

an inner wall with a control board enclosure, the inner wall positioned within the casing between the interior coil and the exterior coil, the control board enclosure having a housing and a cover, the housing defining an interior volume, the cover mounted to the housing in order to provide selective access to the interior volume of the housing, the cover extending between a top edge and a bottom edge, the cover rotatable on a substantially-horizontal axis relative to the housing at the bottom edge of the cover; and a control board mounted to the cover of the control board enclosure and positioned within the interior volume of the housing, the control board rotatable on the substantially-horizontal axis with the cover of the control board enclosure, wherein the cover of control board enclosure has an inner surface and an outer surface positioned opposite each other on the cover of the control board enclosure, the inner surface of the cover facing the interior volume of the housing, the control board positioned at the inner surface of the cover, wherein the control board comprises a printed circuit board and a plurality of electrical connectors, the printed circuit board positioned at the inner surface of the cover, the plurality of electrical connectors extending from the printed circuit board through the cover, of the control board towards the outer surface of the cover, and wherein the plurality of electrical connectors are positioned such that the plurality of electrical connectors are accessible at the outer surface of the cover when the cover of the control board enclosure is mounted to the housing of the control board enclosure.

9. The packaged terminal air conditioner unit of claim 8, wherein the control board comprises a plurality of electrical connectors, the cover of the control board enclosure defining a plurality of holes, each electrical connector of the plurality of electrical connectors positioned at one of the plurality of holes of the cover.

10. The packaged terminal air conditioner unit of claim 8, wherein the control board is snap-fit to the cover of the control board enclosure on the inner surface of the cover.

11. The packaged terminal air conditioner unit of claim 8, further comprising a transformer and a capacitor mounted to the cover of the control board enclosure such that the transformer and the capacitor are rotatable on the substantially-horizontal axis with the cover of the control board enclosure.

12. The packaged terminal air conditioner unit of claim 8, wherein the housing and cover of the control board enclosure are constructed of a metal.

* * * * *